US010531520B2

(12) United States Patent
Ueno et al.

(10) Patent No.: US 10,531,520 B2
(45) Date of Patent: Jan. 7, 2020

(54) MOLDING APPARATUS

(71) Applicants: Sumitomo Heavy Industries, Ltd., Tokyo (JP); Linz Research Engineering Co., Ltd., Tochigi (JP)

(72) Inventors: Norieda Ueno, Kanagawa (JP); Masayuki Ishizuka, Kanagawa (JP); Masayuki Saika, Ehime (JP); Takashi Komatsu, Tochigi (JP)

(73) Assignees: SUMITOMO HEAVY INDUSTRIES, LTD., Tokyo (JP); LINZ RESEARCH ENGINEERING CO., LTD., Tochigi (JP)

( * ) Notice: Subject to any disclaimer, the term of this patent is extended or adjusted under 35 U.S.C. 154(b) by 500 days.

(21) Appl. No.: 15/298,020

(22) Filed: Oct. 19, 2016

(65) Prior Publication Data

US 2017/0048931 A1 Feb. 16, 2017

Related U.S. Application Data

(63) Continuation of application No. PCT/IB2014/001822, filed on Apr. 21, 2014.

(51) Int. Cl.

| | |
|---|---|
| ***H05B 3/00*** | (2006.01) |
| ***B21D 26/041*** | (2011.01) |
| ***C21D 1/60*** | (2006.01) |
| ***C21D 1/673*** | (2006.01) |
| ***C21D 7/13*** | (2006.01) |

(Continued)

(52) U.S. Cl.

CPC ..... *H05B 3/0004* (2013.01); *B21D 26/041* (2013.01); *C21D 1/60* (2013.01);

(Continued)

(58) Field of Classification Search

CPC ..... H05B 3/0004; H05B 3/023; H05B 3/03; C21D 9/08; C21D 9/0062; C21D 7/13

(Continued)

(56) References Cited

U.S. PATENT DOCUMENTS

| | | | |
|---|---|---|---|
| 5,735,156 | A | 4/1998 | Yoshitomi et al. |
| 6,014,879 | A | 1/2000 | Jaekel et al. |

(Continued)

FOREIGN PATENT DOCUMENTS

| | | | |
|---|---|---|---|
| EP | 1 197 274 | A1 | 4/2002 |
| JP | S60-082229 | A | 5/1985 |

(Continued)

OTHER PUBLICATIONS

Office Action issued in Canadian Patent Application No. 2,946,088, dated Oct. 3, 2017.

(Continued)

*Primary Examiner* — Thien S Tran

(74) *Attorney, Agent, or Firm* — Michael Best & Friedrich LLP

(57) ABSTRACT

A molding apparatus capable of improving the quality of a molded article is provided. A control section controls a blowing mechanism to expand and mold a metal pipe material by supplying gas into the metal pipe material held between an upper mold and a lower mold by a pipe holding mechanism. The control section controls a driving section to mold a flange portion by crushing a second molded portion of the expanded metal pipe material in a sub-cavity portion between the upper mold and the lower mold. In a molding apparatus, the control section changes movement speed of a slide during the molding of the flange portion by controlling a servomotor. Accordingly, it becomes possible to control an operation of pressing at an appropriate movement speed according to the shape or the like of the flange portion. Accordingly, it is possible to improve the quality of a molded article.

4 Claims, 8 Drawing Sheets

(51) Int. Cl.

| | |
|---|---|
| ***C21D 9/00*** | (2006.01) |
| ***C21D 9/08*** | (2006.01) |
| ***H05B 3/02*** | (2006.01) |
| ***H05B 3/03*** | (2006.01) |

(52) U.S. Cl.
CPC ..... *C21D 1/673* (2013.01); *C21D 7/13* (2013.01); *C21D 9/0062* (2013.01); *C21D 9/08* (2013.01); *H05B 3/023* (2013.01); *H05B 3/03* (2013.01)

(58) Field of Classification Search
USPC ..... 72/55, 58, 62, 370.22; 219/633
See application file for complete search history.

(56) References Cited

U.S. PATENT DOCUMENTS 6,237,382 B1 5/2001 Kojima et al.
2003/0005737 A1* 1/2003 Gharib ..... B21D 26/043 72/58
2004/0040636 A1 3/2004 Watanabe et al.

FOREIGN PATENT DOCUMENTS

| | | | | |
|---|---|---|---|---|
| JP | 2003-154415 | A | | 5/2003 |
| JP | 2004-0249309 | A | | 9/2004 |
| JP | 2007-069241 | A | | 3/2007 |
| JP | 2009-220141 | A | | 10/2009 |
| JP | 2009220141 | A | * | 10/2009 |
| JP | 2012-000654 | A | | 1/2012 |

OTHER PUBLICATIONS

International Search Report issued in Application No. PCT/IB2014/001822, dated Dec. 23, 2014.
Article 94(3) EPC Communication issued in European Application No. 14796543.8, dated Sep. 19, 2019.

* cited by examiner

MOLDING APPARATUS

RELATED APPLICATION

This is a continuation of International Application No. PCT/IB2014/001822 filed on Apr. 21, 2014, the contents of which, including the specification, the claims and the drawings, are incorporated herein by reference in their entirety.

BACKGROUND

Technical Field

The present invention relates to a molding apparatus which molds a metal pipe with a flange.

Description of Related Art

In the past, a molding apparatus has been known which performs molding by expanding a heated metal pipe material by supplying gas into the heated metal pipe material. For example, a molding apparatus shown in the related art is provided with an upper mold and a lower mold which are paired with each other, a holding section which holds a metal pipe material between the upper mold and the lower mold, and a gas supply section which supplies gas into the metal pipe material held by the holding section. In this molding apparatus, it is possible to mold the metal pipe material into a shape corresponding to the shape of a mold by expanding the metal pipe material by supplying gas into the metal pipe material in a state of being held between the upper mold and the lower mold.

SUMMARY

According to an aspect of the present invention, there is provided a molding apparatus that molds a metal pipe with a flange, including: a first mold and a second mold that are paired with each other; a slide configured to move at least one of the first mold and the second mold; a driving section that is provided with a servomotor configured to generate a driving force for moving the slide; a holding section configured to hold a metal pipe material between the first mold and the second mold; a gas supply section configured to supply gas into the metal pipe material held by the holding section; and a control section configured to control the driving section, the holding section, and the gas supply section, in which the control section controls the gas supply section so as to expand and mold the metal pipe material by supplying gas into the metal pipe material held between the first mold and the second mold by the holding section, controls the driving section so as to mold a flange portion by crushing a portion of the expanded metal pipe material by the first mold and the second mold, and changes movement speed of the slide during molding of the flange portion by controlling the servomotor.

BRIEF DESCRIPTION OF THE DRAWINGS

FIG. 3A is a diagram showing a state where a metal pipe material is set in the mold and FIG. 3B is a diagram showing a state where the metal pipe material is held by an electrode.

FIG. 5A is a diagram showing a state where the electrode holds the metal pipe material, FIG. 5B is a diagram showing a state where a blowing mechanism is in contact with the electrode, and FIG. 5C is a front view of the electrode.

FIG. 6A is a diagram showing a state at the point of time when the metal pipe material is set in the blow molding mold, FIG. 6B is a diagram showing a state at the time of blow molding, and FIG. 6C is a diagram showing a state where a flange portion is molded by pressing.

DETAILED DESCRIPTION

Figure 1:
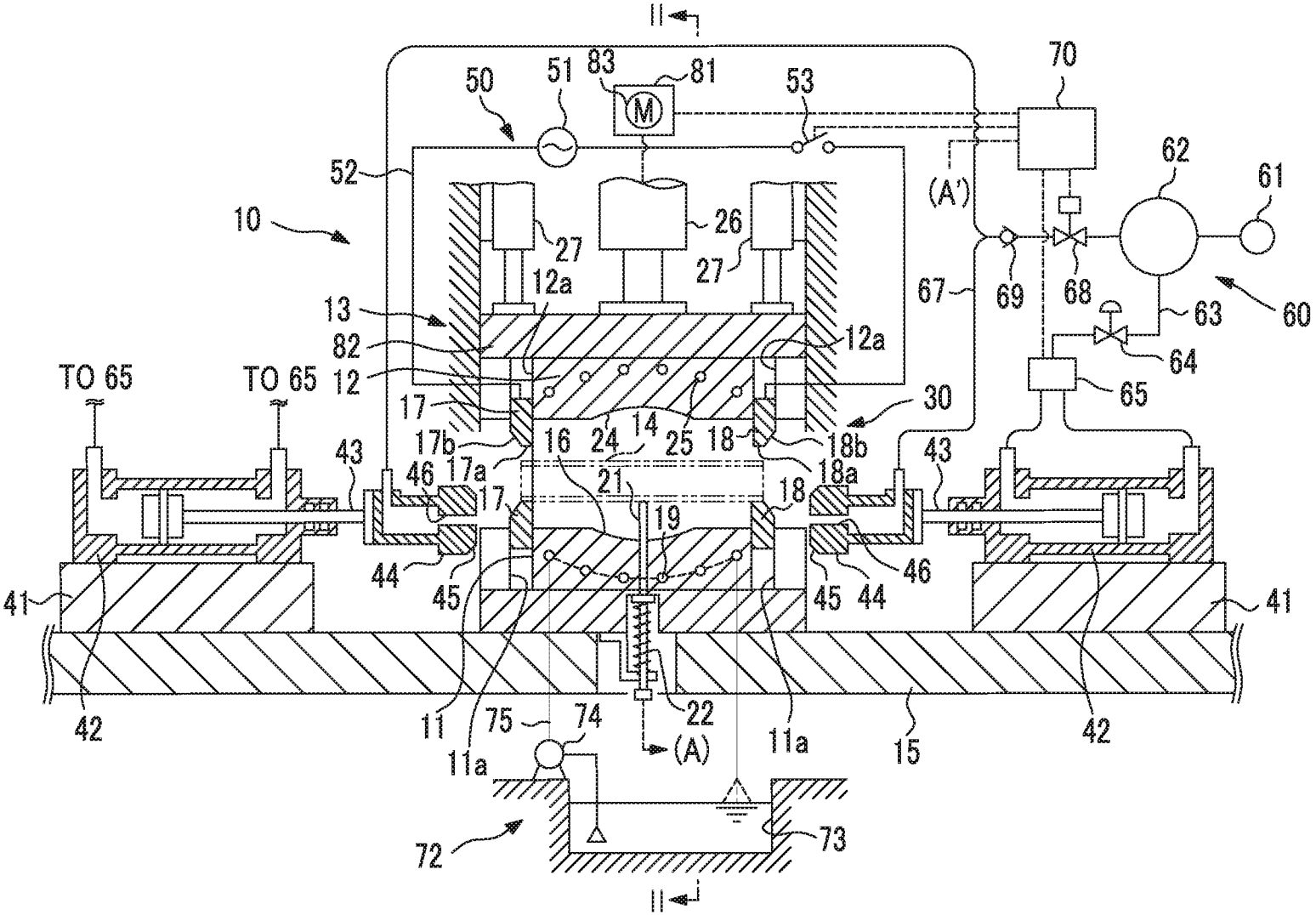
FIG. 1 is a schematic configuration diagram of a molding apparatus according to an embodiment of the present invention.

Here, molding a flange on a metal pipe has been requested. In a case where a metal pipe with a flange is molded by a molding apparatus as described above, a cavity for flange molding having small volume is formed in a mold, a metal pipe is expanded and molded, and a flange can be molded by crushing a portion of the metal pipe material in the cavity for flange molding. In such a case, in a case of molding a flange portion by merely crushing a portion of the metal pipe material, there is a possibility that a slack, twist, or the like may occur in the flange portion, and thus further improvement in the quality of a molded article is requested.

It is desirable to provide a molding apparatus which can improve the quality of a molded article.

In the molding apparatus according to the aspect of the present invention, the control section controls the gas supply section so as to expand and mold the metal pipe material by supplying gas into the metal pipe material held between the first mold and the second mold by the holding section. In this way, the metal pipe material is expanded and molded into a shape corresponding to the first mold and the second mold. Further, the control section controls the driving section so as to mold a flange portion by crushing a portion of the expanded metal pipe material by the first mold and the second mold. Here, the control section changes the movement speed of the slide during the molding of the flange portion by controlling the servomotor. Accordingly, it becomes possible to control an operation of pressing at an appropriate movement speed according to the shape or the like of the flange portion. Accordingly, it is possible to improve the quality of a molded article.

In the molding apparatus according to the aspect of the present invention, the control section may change the amount of movement for each predetermined time period for the slide in a stepwise fashion during molding of the flange portion. In this way, it is possible to make it difficult for cracking of the flange portion to occur, and by increasing the amount of deformation of the flange portion, it is possible to improve formability.

In the molding apparatus according to the aspect of the present invention, the control section may change a movement position of the slide in a curve fashion during molding of the flange portion. In this way, it is possible to improve the stability of the dimensional accuracy of a bending position and improve the performance of impact resistance and fatigue fracture resistance.

In the molding apparatus according to the aspect of the present invention, the control section may increase the amount of movement for each predetermined time period for the slide at a late stage of molding, compared to an initial stage of molding, at the time of molding of the flange portion. In this way, at the initial stage of the molding, by reducing the amount of movement for each predetermined time period for the slide, it is possible to crush the metal pipe material little by little so as not to rapidly deform the metal pipe material. On the other hand, at the late stage of the molding in which the metal pipe material has been deformed to some extent, by increasing the amount of movement for each predetermined time period for the slide, it is possible to promptly mold the final shape of the flange portion.

According to the present invention, it is possible to improve the quality of a molded article.

Configuration of Molding Apparatus

As shown in FIG. 1, a molding apparatus 10 which molds a metal pipe with a flange is configured to include a blow molding mold 13 which includes an upper mold (a first mold) 12 and a lower mold (a second mold) 11, a slide 82 which moves at least one of the upper mold 12 and the lower mold 11, a driving section 81 which generates a driving force for moving the slide 82, a pipe holding mechanism (a holding section) 30 which horizontally holds a metal pipe material 14 between the upper mold 12 and the lower mold 11, a heating mechanism 50 which energizes and heats the metal pipe material 14 held by the pipe holding mechanism 30, a blowing mechanism (a gas supply section) 60 which blows high-pressure gas into the heated metal pipe material 14, a control section 70 which controls the driving section 81, the pipe holding mechanism 30, the heating mechanism 50, and the blowing mechanism 60, and a water circulation mechanism 72 which forcibly water-cools the blow molding mold 13. The control section 70 performs a series of control such as closing the blow molding mold 13 when the metal pipe material 14 has been heated to a quenching temperature (a temperature higher than or equal to an AC3 transformation point temperature) and blowing high-pressure gas into the heated metal pipe material 14. In addition, in the following description, a pipe related to a finished product is referred to as a metal pipe 80 (refer to FIG. 4(*b*)) and a pipe in a stage on the way leading to completion is referred to as the metal pipe material 14.

Figure 5A:
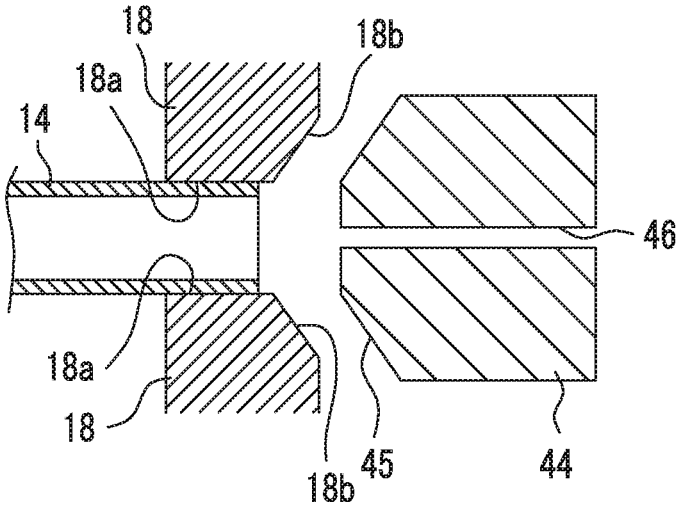
FIGS. 5A to 5C are enlarged views of the periphery of the electrode.
Figure 5B:
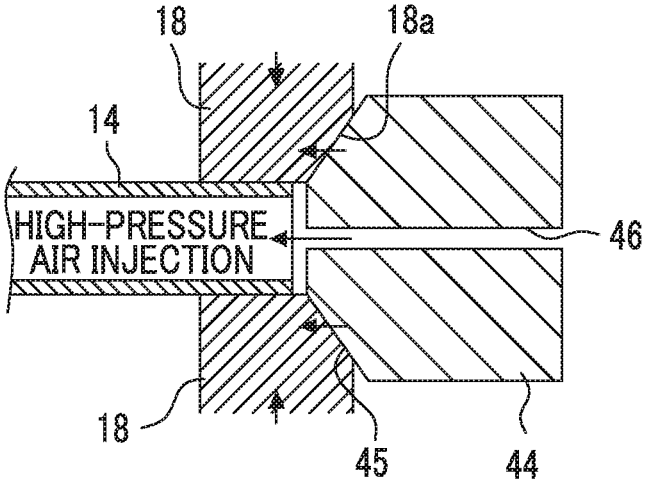
Figure 5C:
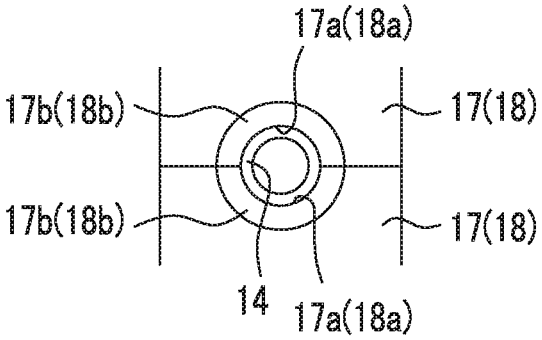

The lower mold 11 is fixed to a large base 15. Further, the lower mold 11 is configured by a large steel block and has a cavity (a concave portion) 16 in the upper surface thereof. In addition, electrode storage spaces 11*a* are provided in the vicinity of right and left ends (right and left ends in FIG. 1) of the lower mold 11, and a first electrode 17 and a second electrode 18 configured so as to be able to be advanced and retreated up and down by an actuator (not shown) are provided in the spaces 11*a*. Semicircular arc-shaped concave grooves 17*a* and 18*a* corresponding to the lower-side outer circumferential surface of the metal pipe material 14 are formed in the upper surfaces of the first and second electrodes 17 and 18 (refer to FIG. 5C), and thus the metal pipe material 14 can be placed so as to be exactly fitted to the portions of the concave grooves 17*a* and 18*a*. Further, the circumferences of the front surfaces (the surfaces in an outward direction of the mold) of the first and second electrodes 17 and 18 are inclined in a tapered shape toward the concave grooves 17*a* and 18*a*, whereby recessed tapered concave surfaces 17*b* and 18*b* are formed. In addition, a cooling water passage 19 is formed in the lower mold 11 and a thermocouple 21 inserted from below is provided in the approximate center. The thermocouple 21 is supported by a spring 22 so as to be able to move up and down.

In addition, a pair of first and second electrodes 17 and 18 which is located on the lower mold 11 side also serves as the pipe holding mechanism 30 and can horizontally support the metal pipe material 14 so as to be able to move up and down between the upper mold 12 and the lower mold 11. Further, the thermocouple 21 merely illustrates an example of temperature measuring means and may be a non-contact type temperature sensor such as a radiation thermometer or an optical thermometer. In addition, if the correlation between energization time and temperature is obtained, it is also sufficiently possible to make a configuration with the temperature measuring means omitted.

The upper mold 12 is a large steel block having a cavity (a concave portion) 24 in the lower surface thereof and having a cooling water passage 25 built-in. The upper mold 12 is fixed to the slide 82 at an upper end portion thereof. Then, the slide 82 with the upper mold 12 fixed thereto is suspended from a pressurizing cylinder 26 and guided by a guide cylinder 27 so as not to laterally oscillate. The driving section 81 according to this embodiment is provided with a servomotor 83 which generates a driving force for moving the slide 82. The driving section 81 is configured by a fluid supply section which supplies a fluid that drives the pressurizing cylinder 26 (hydraulic oil in a case where a hydraulic cylinder is adopted as the pressurizing cylinder 26) to the pressurizing cylinder 26. The control section 70 can control the movement of the slide 82 by controlling the amount of fluid which is supplied to the pressurizing cylinder 26, by controlling the servomotor 83 of the driving section 81. In addition, the driving section 81 is not limited to a configuration to apply a driving force to the slide 82 through the pressurizing cylinder 26, as described above, and may have, for example, a configuration to directly or indirectly apply a driving force that is generated by the servomotor 83 to the slide 82 by mechanically connecting a driving section to the slide 82. In addition, in this embodiment, only the upper mold 12 moves. However, a configuration is also acceptable in which in addition to the upper mold 12 or in place of the upper mold 12, the lower mold 11 moves.

Further, the first electrode 17 and the second electrode 18 configured so as to be able to be advanced and retreated up and down by an actuator (not shown) are provided in electrode storage spaces 12*a* provided in the vicinity of right and left ends (right and left ends in FIG. 1) of the upper mold 12, similar to the lower mold 11. The semicircular arc-shaped concave grooves 17*a* and 18*a* corresponding to the upper-side outer circumferential surface of the metal pipe material 14 are formed in the lower surfaces of the first and second electrodes 17 and 18 (refer to FIG. 5C), and thus the metal pipe material 14 can be exactly fitted to the concave grooves 17*a* and 18*a*. Further, the circumferences of the front surfaces (the surfaces in an outward direction of the mold) of the first and second electrodes 17 and 18 are inclined in a tapered shape toward the concave grooves 17*a* and 18*a*, whereby the recessed tapered concave surfaces 17*b* and 18*b* are formed. That is, a configuration is made such that, if the metal pipe material 14 is gripped by the upper and lower pairs of first and second electrodes 17 and 18 from the upward and downward directions, the outer circumference of the metal pipe material 14 can be exactly surrounded in a close contact manner over the entire circumference.

Figure 2:
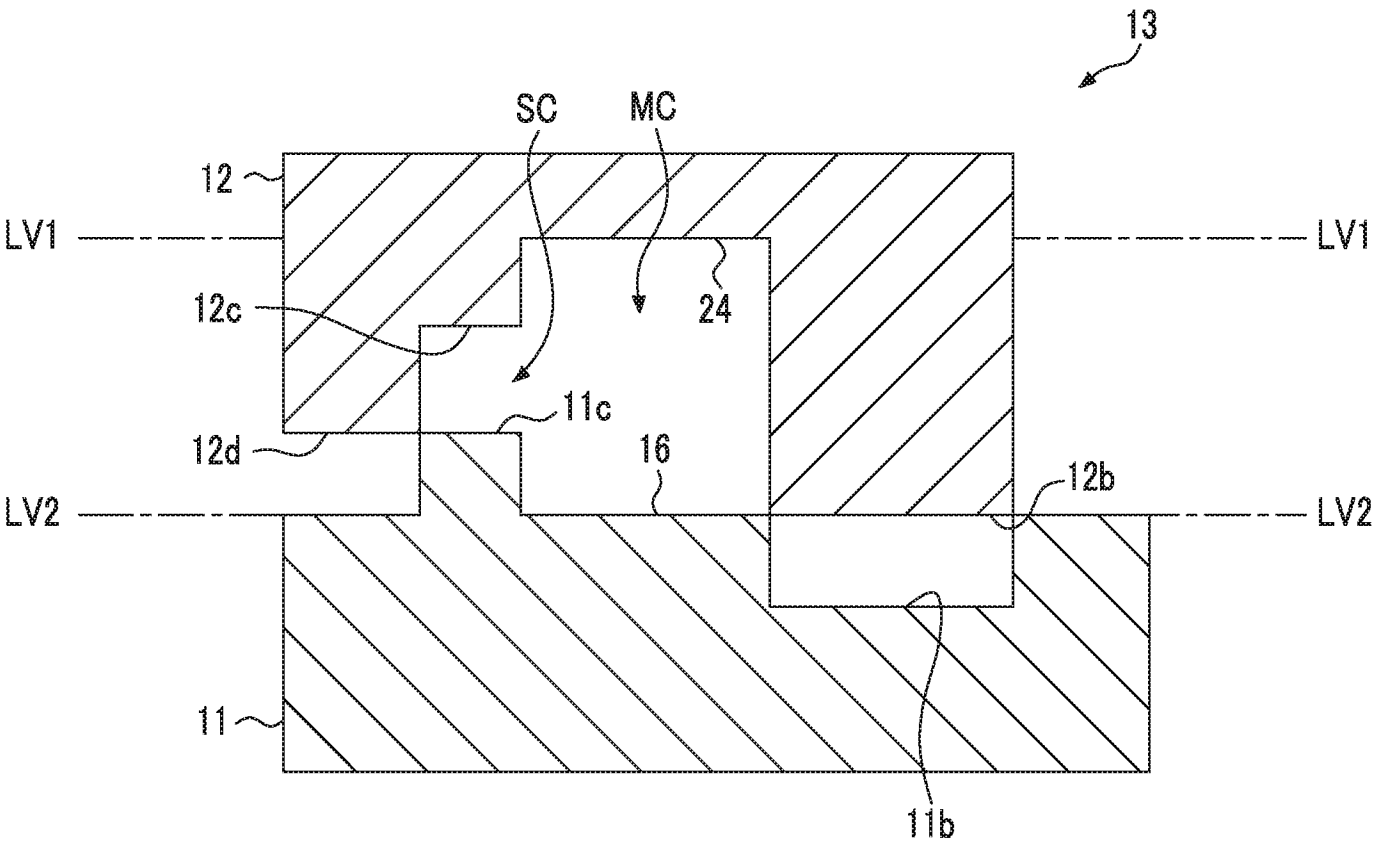
FIG. 2 is a cross-sectional view taken along line II-II shown in FIG. 1 and a schematic cross-sectional view of a blow molding mold.

Next, a schematic cross-section when the blow molding mold 13 is viewed from a side direction is shown in FIG. 2. This is a cross-sectional view of the blow molding mold 13 taken along line II-II in FIG. 1 and viewed in a direction of an arrow and shows the state of a mold position at the time of blow molding. In a case of being viewed from the side, both the upper mold 12 and the lower mold 11 have complicated steps formed on the surfaces thereof.

If the surface of the cavity 24 of the upper mold 12 is set as a reference line LV1, a first projection 12*b*, a second projection 12*c*, and a third projection 12*d* are formed on the surface of the upper mold 12. The first projection 12*b* that protrudes the most is formed on the right side (the right side in FIG. 2) of the cavity 24, and the second projection 12*c* and the third projection 12*d* are formed in a staircase pattern on the left side (the left side in FIG. 2) of the cavity 24. On the other hand, if the surface of the cavity 16 of the lower mold 11 is set as a reference line LV2, on the surface of the lower mold 11, a first concave portion 11*b* is formed on the right side (the right side in FIG. 2) of the cavity 16 and a first projection 11*c* is formed on the left side (the left side in FIG. 2) of the cavity 16. Further, the first projection 12*b* of the upper mold 12 can be exactly fitted into the first concave portion 11*b* of the lower mold 11. Further, the first projection 11*c* of the lower mold 11 can be fitted to a step portion between the second projection 12*c* and the third projection 12*d* of the upper mold 12. As a result of being configured in this manner, as shown in FIG. 2, at a mold position at the time of blow molding, a configuration is made in which a sub-cavity portion SC having small volume is formed next to a main cavity portion MC. The main cavity portion MC is a portion in which a pipe portion 80*a* in the metal pipe 80 is molded, and the sub-cavity portion SC is a portion in which a flange portion 80*b* in the metal pipe 80 is molded.

The heating mechanism 50 is configured to have a power supply 51, a conducting wire 52 extending from the power supply 51 and connected to the first electrode 17 and the second electrode 18, and a switch 53 inserted into the conducting wire 52.

The blowing mechanism 60 is configured to include a high-pressure gas source 61, an accumulator 62 which stores high-pressure gas supplied from the high-pressure gas source 61, a first tube 63 extending from the accumulator 62 to a cylinder unit 42, a pressure control valve 64 and a changeover valve 65 inserted into the first tube 63, a second tube 67 extending from the accumulator 62 to a gas passage 46 formed in a seal member 44, and an ON-OFF valve 68 and a check valve 69 inserted into the second tube 67. In addition, a leading end of the seal member 44 has a tapered surface 45 formed therein such that the leading end is tapered, and is configured in a shape capable of being exactly fitted to and brought into contact with the tapered concave surfaces 17*b* and 18*b* of the first and second electrodes (refer to FIGS. 5A to 5C). In addition, the seal member 44 is connected to the cylinder unit 42 through a cylinder rod 43, thereby being made so as to be able to advance and retreat in accordance with an operation of the cylinder unit 42. Further, the cylinder unit 42 is placed on and fixed to the base 15 through a block 41.

The pressure control valve 64 plays a role to supply high-pressure gas having an operating pressure adapted to be a pushing force which is required from the seal member 44 side, to the cylinder unit 42. The check valve 69 plays a role to prevent the high-pressure gas from flowing back in the second tube 67. The control section 70 obtains temperature information from the thermocouple 21 through transmission of information from (A) to (A') and controls the pressurizing cylinder 26, the switch 53, the changeover valve 65, the ON-OFF valve 68, and the like.

The water circulation mechanism 72 is configured to include a water tank 73 which stores water, a water pump 74 which pumps up and pressurizes the water stored in the water tank 73 and sends the water to the cooling water passage 19 of the lower mold 11 or the cooling water passage 25 of the upper mold 12, and piping 75. Although it is omitted, a cooling tower which lowers water temperature or a filter which purifies water may be inserted into the piping 75.

Operation of Molding Apparatus

Figure 3A:
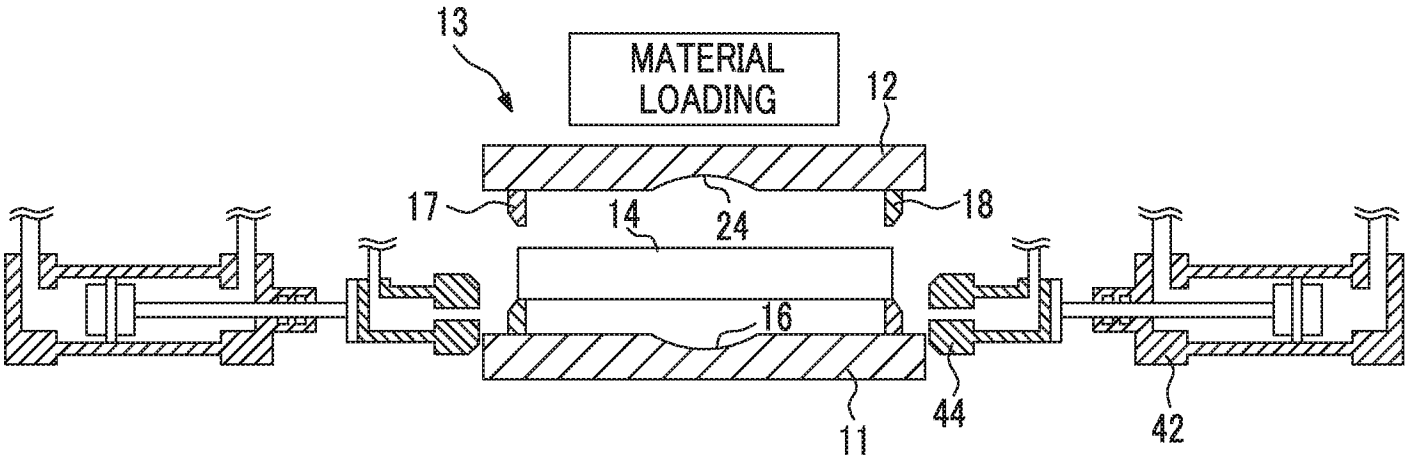
FIGS. 3A and 3B are diagrams showing a manufacturing process by the molding apparatus.
Figure 3B:
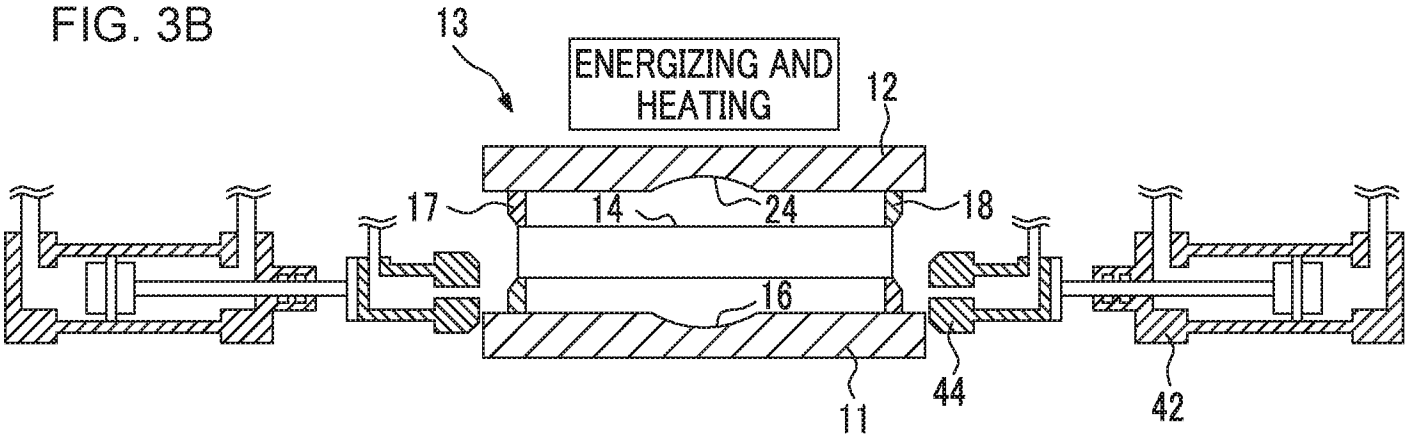

Next, an operation of the molding apparatus 10 will be described. FIGS. 3A and 3B show a manufacturing process from a pipe loading process of loading the metal pipe material 14 as a material to an energizing and heating process of energizing and heating the metal pipe material 14. As shown in FIG. 3A, the metal pipe material 14 of a steel grade capable of being quenched is prepared and the metal pipe material 14 is placed on the first and second electrodes 17 and 18 provided on the lower mold 11 side by a robot armor the like (not shown). Since the concave grooves 17*a* and 18*a* are formed in the first and second electrodes 17 and 18, the metal pipe material 14 is positioned by the concave grooves 17*a* and 18*a*. Next, the control section 70 (refer to FIG. 1) controls the pipe holding mechanism 30 so as to hold the metal pipe material 14 by the pipe holding mechanism 30. Specifically, as in FIG. 3B, an actuator (not shown) capable of advancing and retreating the respective electrodes 17 and 18 is operated, whereby the first and second electrodes 17 and 18 which are respectively located on the upper and lower sides approach each other and come into contact with each other. Due to the contact, both end portions of the metal pipe material 14 are gripped by the first and second electrodes 17 and 18 from above and below. Further, the grip is performed in a close contact aspect over the entire circumference of the metal pipe material 14 due to the existence of the concave grooves 17*a* and 18*a* formed in the first and second electrodes 17 and 18. However, it is not limited to the configuration of performing close contact over the entire circumference of the metal pipe material 14, and a configuration is also acceptable in which the first and second electrodes 17 and 18 come into contact with a portion in a circumferential direction of the metal pipe material 14.

Subsequently, the control section 70 controls the heating mechanism 50 so as to heat the metal pipe material 14. Specifically, the control section 70 switches on the switch 53 of the heating mechanism 50. Then, electric power is supplied from the power supply 51 to the metal pipe material 14 and the metal pipe material 14 itself generates heat (Joule heat) due to resistance which is present in the metal pipe material 14. In this case, the measurement value of the thermocouple 21 is continuously monitored and energization is controlled based on the result.

Figure 4:
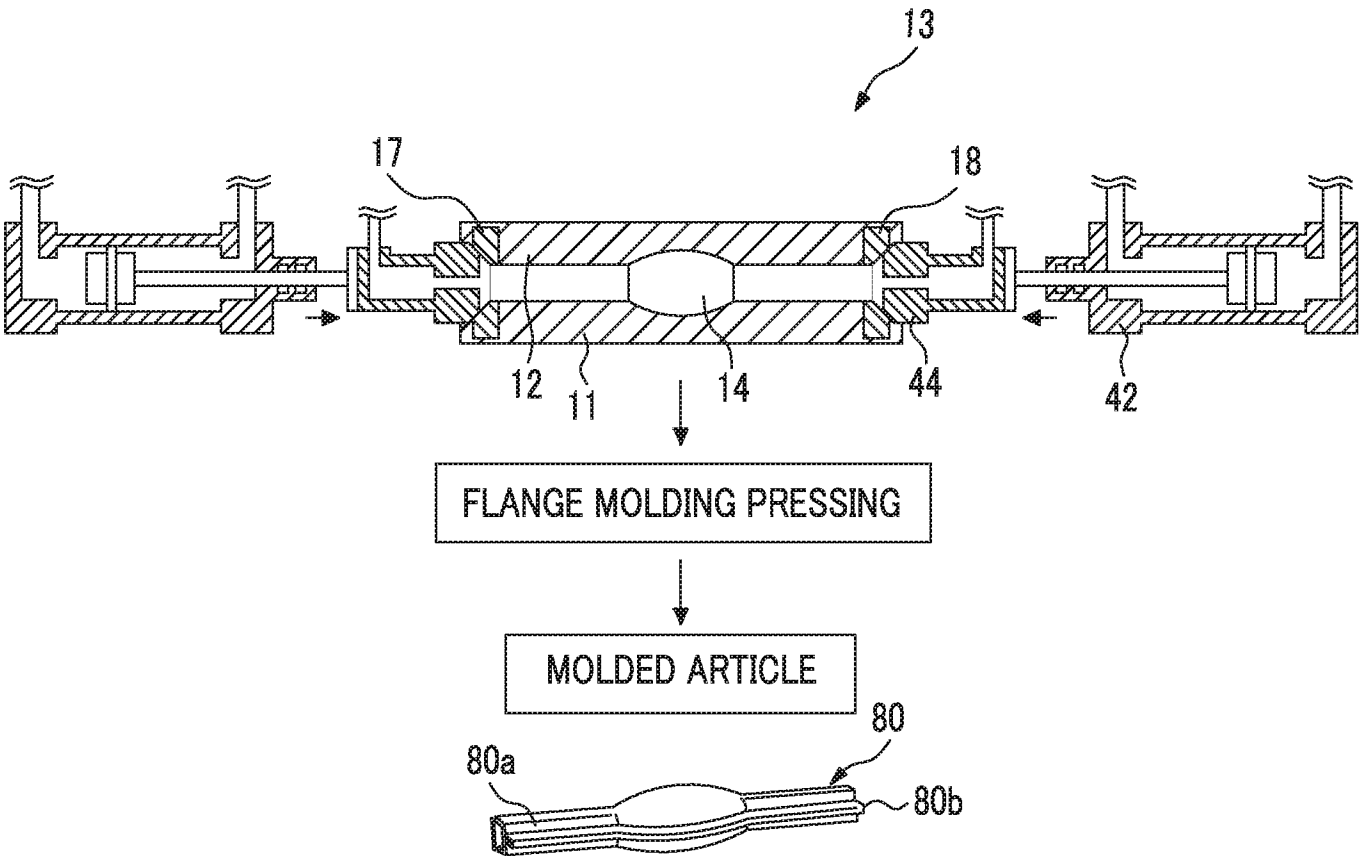
FIG. 4 is a diagram showing a blow molding process by the molding apparatus and a subsequent flow.

FIG. 4 shows a flow in which the metal pipe 80 with a flange, in which the flange portion 80*b* is formed on the pipe portion 80*a*, is obtained as a finished product by molding a flange by pressing on the metal pipe material 14 after the blow molding. The control section 70 controls the blowing mechanism 60 so as to supply gas into the metal pipe material 14 held between the upper mold 12 and the lower mold 11 by the pipe holding mechanism 30 and expands and molds the metal pipe material 14. Further, the control section 70 controls the driving section 81 so as to crush a portion of the expanded and molded metal pipe material 14 in the sub-cavity portion SC between the upper mold 12 and the lower mold 11 and thus molds the flange portion 80*b*. Specifically, as shown in FIG. 4(*a*), the blow molding mold 13 is closed with respect to the metal pipe material 14 after heating, and thus the metal pipe material 14 is disposed and hermetically sealed in the cavity of the blow molding mold 13. Thereafter, the cylinder unit 42 is operated, whereby each of both ends of the metal pipe material 14 is sealed by the seal member 44 that is a portion of the blowing mechanism 60 (refer to FIGS. 5A to 5C together). In addition, the sealing is indirectly performed through the tapered concave surfaces 17*b* and 18*b* formed in the first and second electrodes 17 and 18, rather than being performed by direct contact of the seal members 44 with both end surfaces of the metal pipe material 14. By doing so, sealing can be performed by a wide area, and therefore, seal performance can be improved and in addition, wear of the seal member due to a repeated sealing operation is prevented and collapse or the like of both end surfaces of the metal pipe material 14 is effectively prevented. After the completion of the sealing, high-pressure gas is blown into the metal pipe material 14, whereby the metal pipe material 14 softened due to heating is deformed so as to follow the shape of the cavity. Thereafter, a pressing operation for forming the flange portion 80*b* is performed on the metal pipe material 14 after the blow molding (in this regard, the details will be separately described later). If mold opening is performed, the metal pipe 80 having the pipe portion 80*a* and the flange portion 80*b*, as a finished product, is completed, as shown in FIG. 4(*b*).

The metal pipe material 14 is softened by being heated to a high temperature (around 950° C.), and thus can be blow-molded with relatively low pressure. Specifically, in a case where compressed air having a pressure of 4 MPa and an ordinary temperature (25° C.) is adopted as the high-pressure gas, as a result, the compressed air is heated to around 950° C. in the hermetically-sealed metal pipe material 14. The compressed air thermally expands and reaches a pressure in a range of about 16 MPa to 17 MPa on the basis of the Boyle-Charles' Law. That is, it is possible to easily blow-mold the metal pipe material 14 of 950° C.

Then, the outer circumferential surface of the blow-molded and swelled metal pipe material 14 is rapidly cooled in contact with the cavity 16 of the lower mold 11 and at the same time, is rapidly cooled in contact with the cavity 24 of the upper mold 12 (since the upper mold 12 and the lower mold 11 have large heat capacities and are managed to have a low temperature, if the metal pipe material 14 comes into contact therewith, the heat of the surface of the pipe is removed to the mold side at once), whereby quenching is performed. Such a cooling method is called mold contact cooling or mold cooling. Immediately after the rapid cooling, austenite is transformed into martensite. Since a cooling rate is reduced in the second half of the cooling, the martensite is transformed into another structure (troostite, sorbite, or the like) due to reheating. Therefore, it is not necessary to separately perform tempering treatment.

Figure 6A:
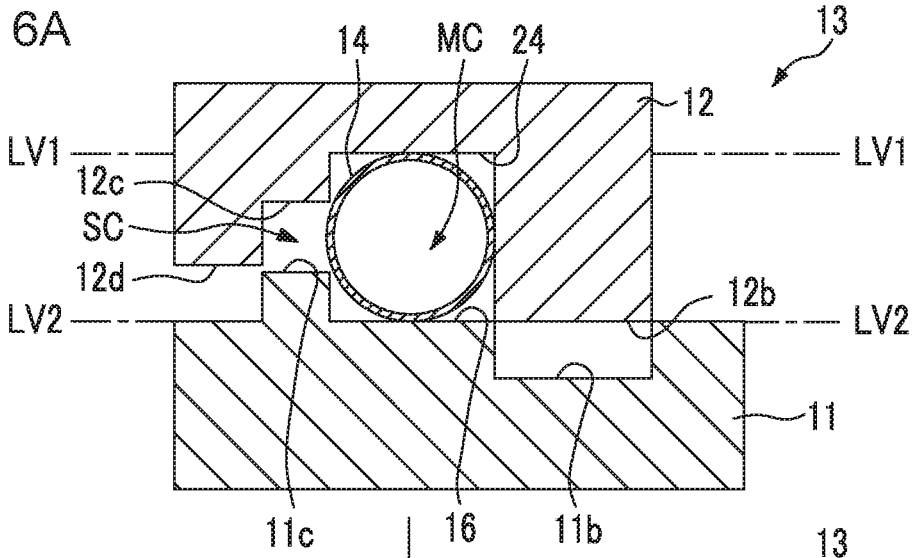
FIGS. 6A to 6C are diagrams showing an operation of the blow molding mold and a change in the shape of the metal pipe material.
Figure 6B:
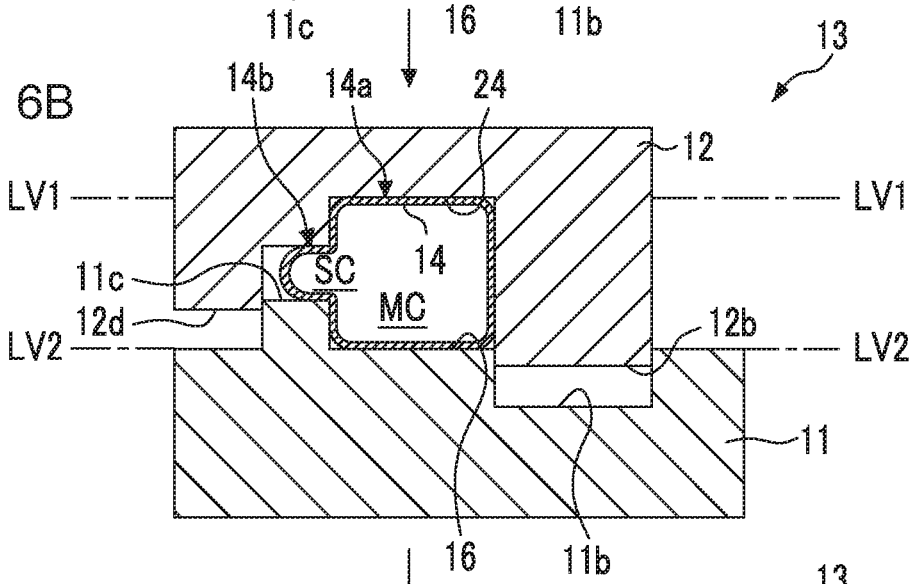

Next, the state of the molding by the upper mold 12 and the lower mold 11 will be described in detail with reference to FIGS. 6A to 6C. In addition, in the following description, a portion corresponding to the pipe portion 80*a* of the metal pipe 80 related to a finished product, of the metal pipe material 14 which is being molded, is referred to as a "first molded portion 14*a*" and a portion corresponding to the flange portion 80*b* is referred to as a "second molded portion 14*b*". As shown in FIGS. 6A and 6B, in the molding apparatus 10 according to the present invention, the blow molding is not performed in a state where the upper mold 12 and the lower mold 11 are completely closed (clamped). That is, the blow molding is performed in a state where a constant separation state is maintained, whereby the sub-cavity portion SC is formed next to the main cavity portion MC. In this state, the main cavity portion MC is formed between the surface on the reference line LV1 of the cavity 24 and the surface on the reference line LV2 of the cavity 16. Further, the sub-cavity portion SC is formed between the surface of the second projection 12*c* of the upper mold 12 and the surface of the first projection 11*c* of the lower mold 11. The main cavity portion MC and the sub-cavity portion SC are in a state of communicating with each other. As a result, as shown in FIG. 6B, the metal pipe material 14 which is softened due to heating and in which high-pressure gas is injected enters not only the main cavity portion MC, but also the portion of the sub-cavity portion SC and expands therein. In the example shown in FIGS. 6A to 6C, since the main cavity portion MC is configured as a rectangular cross-sectional shape, the metal pipe material 14 is blow-molded in accordance with the shape, thereby being molded into a rectangular cross-sectional shape. In addition, the portion corresponds to the first molded portion 14*a* which becomes the pipe portion 80*a*. However, the shape of the main cavity portion MC is not particularly limited and any shape such as a circular shape, an elliptical shape, or a polygonal shape may be adopted in accordance with a desired shape. Further, since the main cavity portion MC and the sub-cavity portion SC communicate with each other, a portion of the metal pipe material 14 enters the sub-cavity portion SC. The portion corresponds to the second molded portion 14*b* which is crushed, thereby becoming the flange portion 80*b*.

Figure 6C:
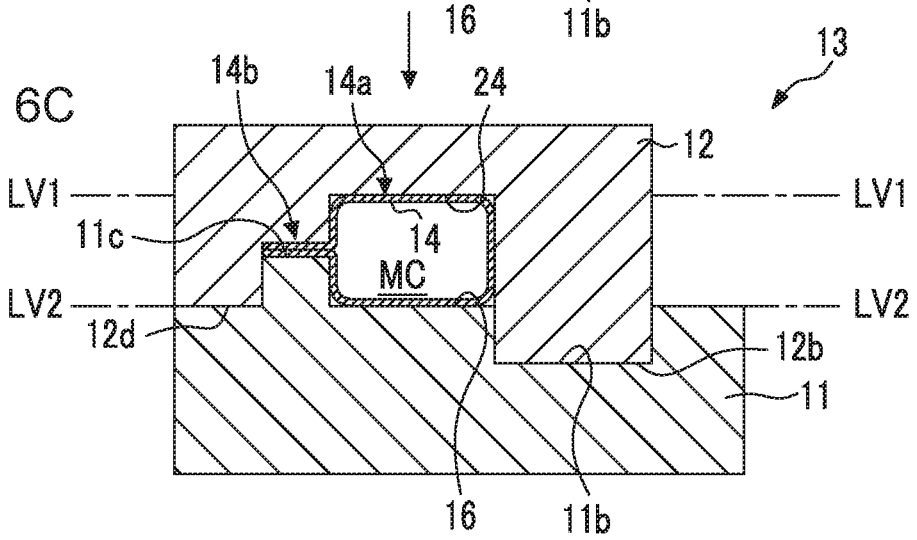

As shown in FIG. 6C, after the blow molding or at a stage during the course of the blow molding, the upper mold 12 and the lower mold 11 which are separated from each other approach each other. Due to this operation, the volume of the sub-cavity portion SC is reduced, and thus the internal space of the second molded portion 14*b* disappears and a folded state is created. That is, due to the approach of the upper mold 12 and the lower mold 11, the second molded portion 14*b* of the metal pipe material 14 entering the sub-cavity portion SC is pressed and crushed. As a result, the second molded portion 14*b* crushed so as to follow a longitudinal direction of the metal pipe material 14 (in this state, the metal pipe material 14 has the same shape as that of the metal pipe 80 as a finished product) is molded on the outer circumferential surface of the metal pipe material 14. In addition, the time from the blow molding to the completion of the press molding of the flange portion 80*b* also depends on the type of the metal pipe material 14. However, it is completed approximately in a range of 1 second to 2 seconds. In addition, in the example shown in FIGS. 6A to 6C, the surface of the first projection 12*b* of the upper mold 12 comes into contact with the bottom surface of the first concave portion 11*b* of the lower mold 11, and thus a state is created where the upper mold 12 and the lower mold 11 cannot come close to each other anymore.

Next, control of the movement speed of the slide 82 (that is, the movement speed of the upper mold 12) will be described with reference to FIGS. 7A to 8F. In the molding apparatus 10 according to this embodiment, since the driving section 81 is provided with the servomotor 83, it is possible to perform servo pressing. The control section 70 controls the servomotor 83, thereby changing the movement speed of the slide 82 during the molding of the flange portion 80*b*. In addition, the point of time when the descent of the upper mold 12 is started in order to crush the second molded portion 14*b* expanded toward the sub-cavity portion SC, as shown in FIG. 6B, is set to be a start time point T1 of the molding of the flange portion 80*b* and the point of time when the upper mold 12 descends to the bottom dead center, thereby making the second molded portion 14*b* into the shape of the flange portion 80*b*, as shown in FIG. 6C, is set to be a completion time point 12 of the molding of the flange portion 80*b*. In the graphs shown in FIGS. 7A to 8F, a time domain in which the flange portion 80*b* is being molded is set as a flange portion molding domain E2. In addition, after the flange portion 80*b* is molded, the upper mold 12 is maintained at a predetermined pressure in the bottom dead center and cooling is performed, whereby the molding of the entire metal pipe 80 is performed. In the graphs shown in FIGS. 8A to 8F, a time domain in which the molding of the entire metal pipe 80 is performed is set as an entire molding domain E3. Further, a time domain in which the flange portion molding domain E2 and the entire molding domain E3 are combined is set as a molding domain E1.

Figure 7A:
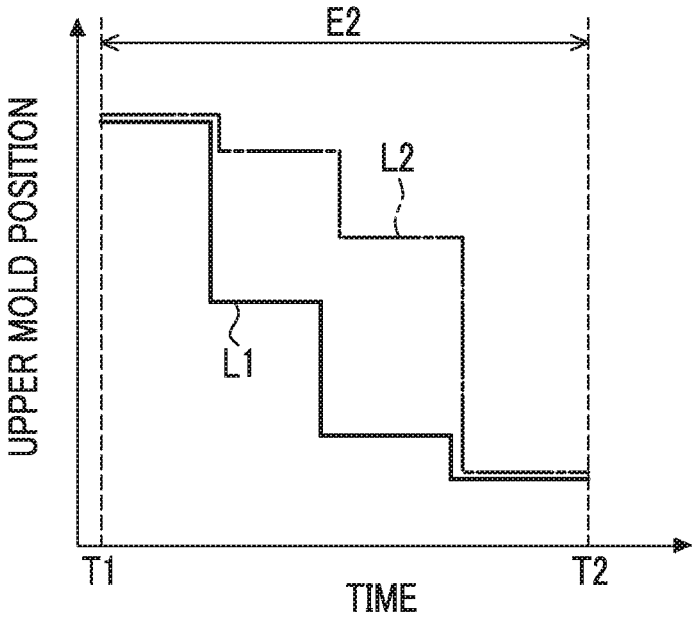
FIGS. 7A and 7B are graphs showing an example of an aspect of the speed control of a slide by a control section.

As shown in FIG. 7A, the control section 70 may change the amount of movement for each predetermined time period for the slide 82 in a stepwise fashion during the molding of the flange portion 80*b*. That is, the control section 70 may change the amount of movement for each predetermined time period for the upper mold 12 in a stepwise fashion in the flange portion molding domain E2. In the example shown in FIG. 7A, the control section 70 changes the amount of movement for each predetermined time period in a stepwise fashion by performing control such that a graph showing the relationship between a movement position of the upper mold 12 (that is, the slide 82) and time depicts a stairs shape. The upper mold 12 is maintained at the same position only for a predetermined time, then rapidly descends by a predetermined movement amount, and thereafter, is maintained at the same position only for a predetermined time. In addition, in the drawing, the graph when the control section makes the upper mold 12 descend changes substantially vertically. However, the graph may change so as to depict a straight line which is inclined obliquely downward. Further, the length or the interval of the time when the upper mold 12 is maintained at the same position may also be changed appropriately. In this manner, by changing the amount of movement of the upper mold 12 (that is, the slide 82) in a stepwise fashion for each predetermined time period, it is possible to make it difficult for cracking of the flange portion 80*b* to occur, and by increasing the amount of deformation of the flange portion 80*b*, it is possible to improve formability.

Figure 7B:
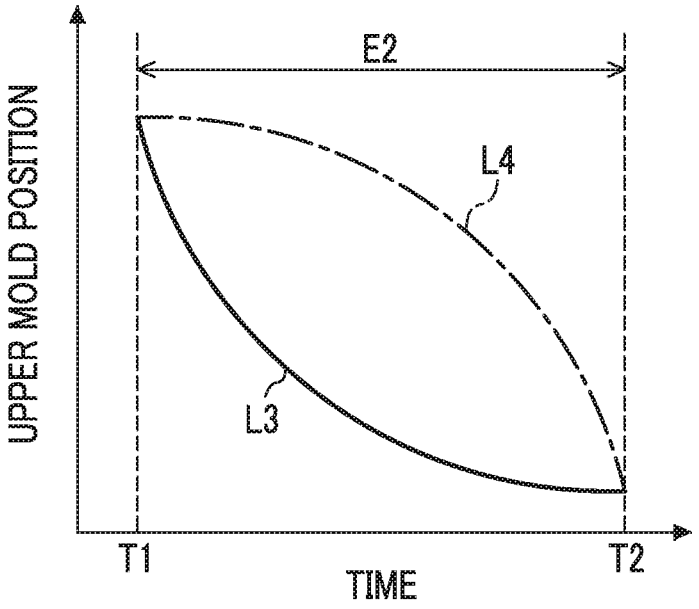

As shown in FIG. 7B, the control section 70 may change the movement position of the slide 82 in a curve fashion during the molding of the flange portion 80*b*. That is, the control section 70 may change the movement position of the upper mold 12 in a curve fashion in the flange portion molding domain E2. The control section 70 performs control such that a graph showing the relationship between a movement position of the upper mold 12 and time depicts a curve, as shown in FIG. 7B, by making the upper mold 12 descend while gradually changing the movement speed of the slide 82. In this manner, by changing the movement position of the upper mold 12 (that is, the slide 82) in a curve fashion, it is possible to improve the stability of the dimensional accuracy of a bending position and improve the performance of impact resistance and fatigue fracture resistance.

Further, the control section 70 may reduce the amount of movement for each predetermined time period for the slide 82 in the late stage of the molding, compared to the initial stage of the molding, at the time of the molding of the flange portion 80*b*. In addition, the initial stage of the molding is a time domain closer to the start time point T1 side than the intermediate time point of the flange portion molding domain E2. Further, the late stage of the molding is a time domain closer to the completion time point 12 side than the intermediate time point of the flange portion molding domain E2. Specifically, as shown in a graph L1 of FIG. 7A, the control section 70 increases the amount of movement of the slide 82, thereby making the upper mold 12 greatly descend, at the initial stage of the molding, and on the other hand, reduces the amount of movement along with elapse of time, thereby reducing the amount of movement of the slide 82, at the late stage of the molding. Further, as shown in FIG. 7B, the control section 70 controls the slide 82 such that the movement position of the upper mold 12 depicts a curved graph L3 which is curved so as to be convex downward. As described above, at the initial stage of the molding, by increasing the amount of movement for each predetermined time period for the slide 82, it is possible to mold the rough shape of the flange portion 80*b*, and at the late stage of the molding, by reducing the amount of movement for each predetermined time period for the slide 82, it is possible to mold the fine shape of the flange portion 80*b* with high accuracy.

Further, the control section 70 may increase the amount of movement for each predetermined time period for the slide 82 in the late stage of the molding, compared to the initial stage of the molding, at the time of the molding of the flange portion 80*b*. Specifically, as shown in a graph L2 of FIG. 7A, the control section 70 reduces the amount of movement of the slide 82, thereby making the upper mold 12 descend by a small amount, at the initial stage of the molding, and on the other hand, increases the amount of movement along with elapse of time, thereby increasing the amount of movement of the slide 82, at the late stage of the molding. Further, as shown in FIG. 7B, the control section 70 controls the slide 82 such that the movement position of the upper mold 12 depicts a curved graph L4 which is curved so as to be convex upward. As described above, at the initial stage of the molding, by reducing the amount of movement for each predetermined time period for the slide 82, it is possible to crush the metal pipe material 14 little by little so as not to rapidly deform the metal pipe material 14. For example, in terms of the characteristics of a material of the metal pipe material 14, in a case of rapidly deforming the metal pipe material 14, there is a possibility that distortion or the like may occur due to an increase in reaction force. However, by crushing the metal pipe material 14 little by little, it is possible to precisely deform the metal pipe material 14. On the other hand, at the late stage of the molding in which the metal pipe material 14 has been deformed to some extent, by increasing the amount of movement for each predetermined time period for the slide 82, it is possible to promptly mold the final shape of the flange portion 80*b*.

Figure 8A:
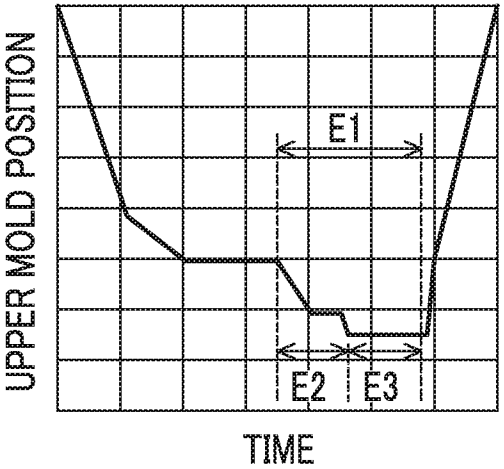
FIGS. 8A to 8F are graphs showing an example of an aspect of the speed control of the slide by the control section.
Figure 8B:
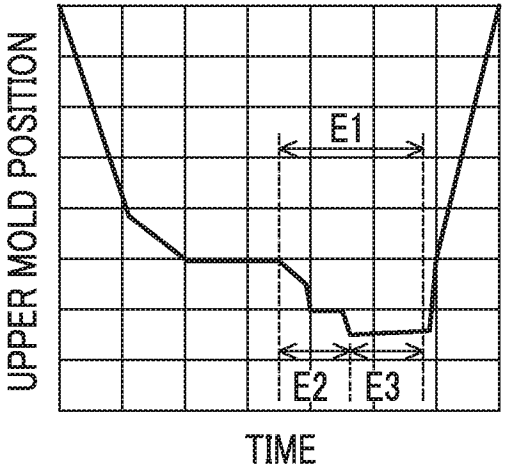
Figure 8C:
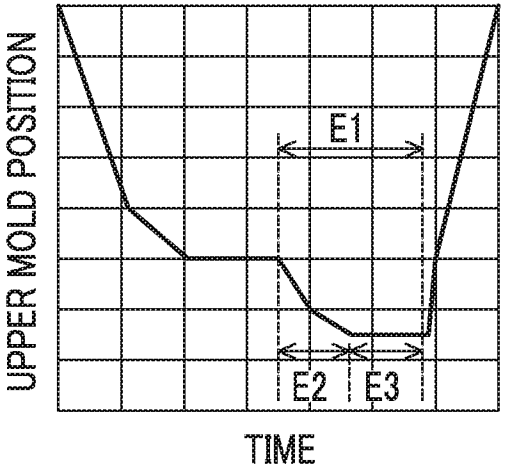

Further, the control section 70 may perform control by changing the movement speed of the slide 82 in various aspects without being limited to the graph as shown in FIGS. 7A and 7B. As shown in, for example, FIGS. 8A and 8B, the control section 70 may change the movement position of the upper mold 12 (that is, the slide 82) in a staircase pattern, thereby changing the movement position of the upper mold 12 so as to depict a straight line which is inclined obliquely downward, when changing the amount of movement for each predetermined time period in a stepwise fashion. Further, as shown in FIG. 8C, the movement position of the upper mold may be changed so as to depict a straight line with a different inclination angle after the movement position of the upper mold 12 is changed so as to depict a straight line which is inclined obliquely downward, without providing a domain in which the movement position of the upper mold 12 is maintained for a certain period of time. Such control also corresponds to the control to change the movement position of the upper mold 12 (that is, the slide 82) in a staircase pattern.

Figure 8D:
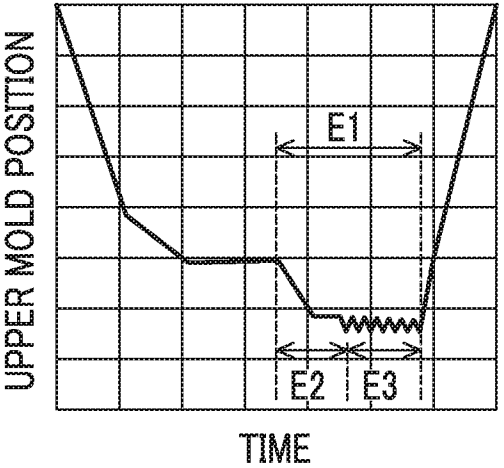
Figure 8E:
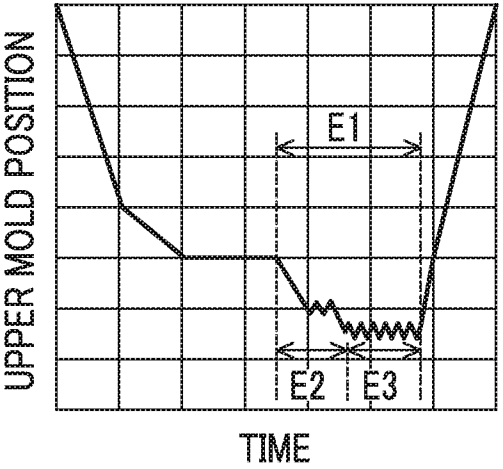
Figure 8F:
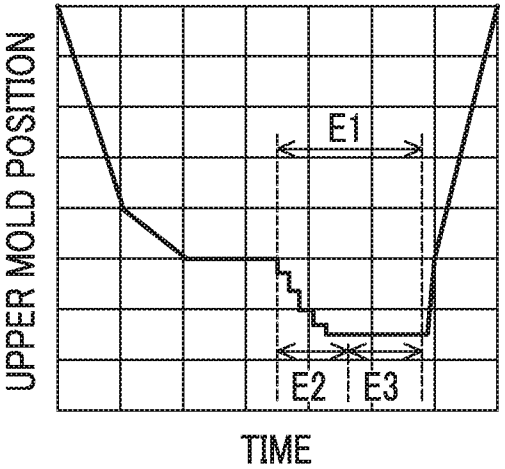

Further, as shown in FIGS. 8D, 8E, and 8F, oscillating pressure may be added at any timing in the molding domain E1. In addition, the expression "adding oscillating pressure" refers to applying pressure that changes minutely, to the metal pipe material 14 by oscillating the upper mold 12 (repeating a pattern of slightly moving up and down) in a state where the metal pipe material 14 is pressed by the upper mold 12 and the lower mold 11. As shown in, for example, FIG. 8D, the control section 70 may apply oscillating pressure to the metal pipe material 14 in the entire molding domain E3. Further, as shown in FIG. 8E, oscillating pressure may be applied to the metal pipe material 14 in the flange portion molding domain E2 and the entire molding domain E3. In addition, in the flange portion molding domain E2, the oscillating pressure is applied in a domain in which the movement position of the upper mold 12 is maintained for a certain period of time. Further, as shown in FIG. 8F, the control section 70 may apply oscillating pressure to the metal pipe material 14 in the flange portion molding domain E2. In addition, in the flange portion molding domain E2, the oscillating pressure is applied while making the upper mold 12 descend. As described above, the effects such as the better flatness of a molded surface and the suppression of spring-back are exhibited by applying oscillating pressure to the metal pipe material 14.

Next, an operation and effects of the molding apparatus 10 according to this embodiment will be described.

In the molding apparatus 10 according to this embodiment, the control section 70 controls the blowing mechanism 60 so as to expand and mold the metal pipe material 14 by supplying gas into the metal pipe material 14 held between the upper mold 12 and the lower mold 11 by the pipe holding mechanism 30. In this way, a portion (that is, the first molded portion 14*a*) corresponding to the pipe portion 80*a* of a finished product, of the metal pipe material 14, is expanded and molded into a shape corresponding to the main cavity portion MC and a portion (that is, the second molded portion 14*b*) corresponding to the flange portion 80*b* of the finished product expands toward the sub-cavity portion SC. Further, the control section 70 controls the driving section 81 so as to mold the flange portion 80*b* by crushing the second molded portion 14*b* of the expanded metal pipe material 14 in the sub-cavity portion SC between the upper mold 12 and the lower mold 11. Here, as a molding apparatus related to a comparative example, a molding apparatus which molds the flange portion 80*b* without performing speed control by the servomotor 83 when crushing the second molded portion 14*b* expanded toward the sub-cavity portion SC can be given. In such a case, there is a possibility that a slack, twist, or the like may occur in the flange portion 80*b*.

On the other hand, in the molding apparatus 10 according to this embodiment, the control section 70 controls the servomotor 83, thereby changing the movement speed of the slide 82 during the molding of the flange portion 80*b*. Accordingly, it becomes possible to control an operation of pressing at an appropriate movement speed according to the shape or the like of the flange portion 80*b*. Accordingly, it is possible to improve the quality of amolded article. Here, in the molding method according to this embodiment, if internal pressure exceeds the deformation resistance of the metal pipe material 14 in a state where the inside of the metal pipe material 14 is filled with high-pressure gas, the metal pipe material 14 is deformed in accordance with the shape of the blow molding mold 13. In this case, in a process of swelling and molding the flange portion 80*b*, the upper mold 12 is descending near the bottom dead center. In this case, by controlling an operation of a servo pressing based on appropriate conditions regarding shape molding with respect to internal pressure, it becomes possible to mold a high-precision shape.

The present invention is not limited to the embodiment described above.

In the molding apparatus 10 described above, the heating mechanism 50 capable of performing heating treatment between the upper and lower molds is provided and the metal pipe material 14 is heated by using Joule heat by energization. However, the present invention is not limited thereto. For example, a configuration is also acceptable in which heating treatment is performed at a place other than the place between the upper and lower molds and a metallic pipe after the heat is transported into an area between the molds. Further, besides the use of Joule heat by energization, radiation heat of a heater or the like may be used, and it is also possible to perform heating by using a high-frequency induction current.

As the high-pressure gas, a non-oxidizing gas or an inert gas such as nitrogen gas or argon gas is adopted mainly. However, although it is possible to make generation of oxidized scale in a metal pipe difficult, these gases are expensive. In this regard, in the case of compressed air, as long as a major problem due to the generation of oxidized scale is not caused, it is inexpensive, even if it leaks into the atmosphere, there is no actual harm, and handling is very easy. Therefore, it is possible to smoothly carry out a blowing process.

The blow molding mold may be any of a non-water-cooled mold and a water-cooled mold. However, the non-water-cooled mold needs a long time when reducing the temperature of the mold to a temperature near an ordinary temperature after the end of blow molding. In this regard, in the case of the water-cooled mold, cooling is completed in a short time. Therefore, from the viewpoint of improvement in productivity, the water-cooled mold is preferable.

According to the molding apparatus related to an embodiment of the present invention, it is possible to improve the quality of a molded article.

It should be understood that the invention is not limited to the above-described embodiment, but may be modified into various forms on the basis of the spirit of the invention. Additionally, the modifications are included in the scope of the invention.

What is claimed is:

1. A molding apparatus that molds a metal pipe with a flange, comprising:

a first mold and a second mold that are paired with each other;

a slide configured to move at least one of the first mold and the second mold;

a driving section that is provided with a servomotor configured to generate a driving force for moving the slide;

a holding section configured to hold a metal pipe material between the first mold and the second mold;

a gas supply section configured to supply gas into the metal pipe material held by the holding section; and a control section configured to control the driving section, the holding section, and the gas supply section, wherein the control section controls the gas supply section so as to expand and mold the metal pipe material by supplying gas into the metal pipe material held between the first mold and the second mold by the holding section, controls the driving section so as to mold a flange portion by crushing a portion of the expanded metal pipe material by the first mold and the second mold, and changes movement speed of the slide during molding of the flange portion by controlling the servomotor.

2. The molding apparatus according to claim 1, wherein the control section changes an amount of movement for each predetermined time period for the slide in a stepwise fashion during molding of the flange portion.

3. The molding apparatus according to claim 1, wherein the control section changes a movement position of the slide in a curve fashion during molding of the flange portion.

4. The molding apparatus according to claim 1, wherein the control section increases an amount of movement for each predetermined time period for the slide at a late stage of molding, compared to an initial stage of molding, at the time of molding of the flange portion.

* * * * *